US006520797B2

(12) United States Patent
Okamura et al.

(10) Patent No.: US 6,520,797 B2
(45) Date of Patent: Feb. 18, 2003

(54) CONNECTOR TERMINAL AND A METHOD FOR PRODUCING THE SAME

(75) Inventors: Kenji Okamura, Nagoya (JP); Hiroki Hirai, Nagoya (JP); Yoshito Sakai, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/078,112

(22) Filed: Feb. 20, 2002

(65) Prior Publication Data

US 2002/0119696 A1 Aug. 29, 2002

(30) Foreign Application Priority Data

Feb. 23, 2001 (JP) ..... 2001-048130

(51) Int. Cl.[7] ..... H01K 12/24
(52) U.S. Cl. ..... 439/495
(58) Field of Search ..... 439/495, 67, 496, 439/493

(56) References Cited

U.S. PATENT DOCUMENTS 3,923,364 A * 12/1975 Shapiro et al. ..... 174/117 F
5,277,621 A * 1/1994 Seto ..... 439/493
5,928,027 A * 7/1999 Kunishi ..... 439/495
6,116,948 A * 9/2000 Kunishi ..... 439/495
6,250,966 B1 * 6/2001 Hashimoto et al. ..... 439/495
6,338,648 B1 * 1/2002 Miura et al. ..... 439/260
6,386,905 B1 * 5/2002 Ito ..... 439/493

* cited by examiner

*Primary Examiner*—Tho D. Ta
*Assistant Examiner*—Edwin A León
(74) *Attorney, Agent, or Firm*—Oliff & Berridge, PLC

(57) ABSTRACT

A connector terminal is provided with a press-in portion extending in forward and backward directions; a trunk portion (joining portion) extending downward from the press-in portion; a base portion extending forward and backward from the bottom end (leading end) of the trunk portion, a pair of deflectable pieces for connection (contact portions) which are vertically resiliently displaceable, extend forward and backward from the base portion at the front and rear sides of the trunk portion and have contacts at their sides opposite from the press-in portions; and a leg portion extending upward from the rear end of the press-in portion. The connector terminal is inserted into a corresponding cavity from behind the housing with a leading end of the press-in portion faced forward, and is accommodated and held in the cavity by pressing the leading end into a fixing hole formed in the housing and engaging a hook provided at the leading end with the housing. Contact portions can be effectively prevented from undergoing a deformation (plastic deformation) during the insertion of the connector terminal into the connector housing.

8 Claims, 13 Drawing Sheets

CONNECTOR TERMINAL AND A METHOD FOR PRODUCING THE SAME

BACKGROUND OF THE INVENTION

This invention relates to a connector terminal used in a flat wire member connector for electrically connecting a flat cable, a ribbon wire, a FPC (flexible printed circuit) or like flat wire member, in which flat rectangular conductors are arrayed side by side, with a circuit board or the like and also to a method for producing such a connector terminal.

There has been generally known a flat wire member connector comprised of a female connector housing (hereinafter, merely "hosing") which accommodates a plurality of connector terminals (hereinafter, merely "terminals") side by side and in which conductors of a flat wire member are brought into contact with the terminals by connecting a mating connector housing mounted at an end of the flat wire member with the housing.

Besides the connectors of the above type that the connector housings are connected with each other, there are also connectors of such a type that the conductors of the flat wire member are brought into contact with the terminals by inserting the end of the flat wire member into the housing with a plate-shaped member called a slider (supporting member) placed on the end portion of the flat wire member.

In the field of the above flat wire member connectors, a two-direction connection type provided with insertion openings for flat wire member at both front and rear sides has also been developed. For example, such a connector is expected to be of utility value in the case that a plurality of electric modules are connected in a chain.

The flat wire member connector of the two-direction connection type includes terminals each having contact portions at its front and rear sides and provided in the housing having the insertion openings at the front and rear sides. When the flat wire members are inserted through the respective insertion openings, the conductors of the respective flat wire members are brought into contact with the respective contact portions, whereby corresponding pairs of the conductors of the two flat wire members are connected with each other via the common terminals and the respective conductors are electrically connected with a circuit board or the like.

In the flat wire member connector of this type, the terminals are generally inserted into the respective cavities from front or behind and are held in the housing by having part thereof pressed and locked in fixing holes or the like formed in the housing. Concerning this point, there is one problem in the flat wire member connector of the two-direction connection type. Specifically, the terminal used in the flat wire member connector of the two-direction connection type is easily deflectable since having a long and narrow shape provided with a pair of contact portions at the front and rear sides. Thus, during the insertion of the terminal into the housing, the contact portions may undergo a plastic deformation upon being subjected to a compression load particularly while part of the terminal is pressed into the fixing hole. As a result, a contact failure or other problem may occur later.

Accordingly, it is desired to solve this problem in respect of construction. Further, in a small-size connector, it is difficult to insert the terminals since the terminals are also smaller. This point also needs to be solved.

SUMMARY OF THE INVENTION

It is an object of the present invention to provide a connector terminal and a connector terminal producing method which are free from the problems residing in the prior art.

According to an aspect of the invention, a connector terminal comprises a press-in portion extending in forward and backward directions and be pressed into a fixing hole formed in a connector housing from the front end side thereof, and a pair of front and rear contact portions provided at positions vertically displaced from the press-in portion to be brought into contact with the flat wire members. The contact portions are joined to the press-in portion via a portion between the contact portions.

These and other objects, features and advantages of the present invention will become more apparent upon a reading of the following detailed description and accompanying drawings.

BRIEF DESCRIPTION OF THE DRAWINGS

FIGS. 3A and 3B are sectional views showing the flat wire member connector, wherein FIG. 3A shows a state where a flat wire member is inserted through an insertion opening at the rear side of the flat wire member connector, and FIG. 3B shows a state where the flat wire member inserted through the rear insertion opening is fixed and a mating connector is being connected with the front side of the flat wire member connector;

FIGS. 4A and 4B are sectional views showing the flat wire member connector, wherein FIG. 4A shows a state where the flat wire member inserted through the rear insertion opening is fixed and a mating connector is being connected with the front side of the flat wire member connector, and FIG. 4B shows a state where connection of the flat wire members with both front and rear sides of the flat wire member connector is completed;

FIGS. 7A and 7B are diagrams showing a construction of the housing and connector terminals of the flat wire member connector, wherein FIG. 7A shows a state where the connector terminals are not yet accommodated and FIG. 7B shows a state where the connector terminals are accommodated;

FIGS. 9A and 9B are sectional views showing the construction of the mating connector to be connected with the flat wire member connector, wherein FIG. 9A shows a state of the mating connector before being mounted on the flat wire member (before assembling) and FIG. 9B shows a state thereof after being mounted on the flat wire member (after assembling);

DETAILED DESCRIPTION OF THE PREFERRED EMBODIMENTS OF THE INVENTION

Figure 1:
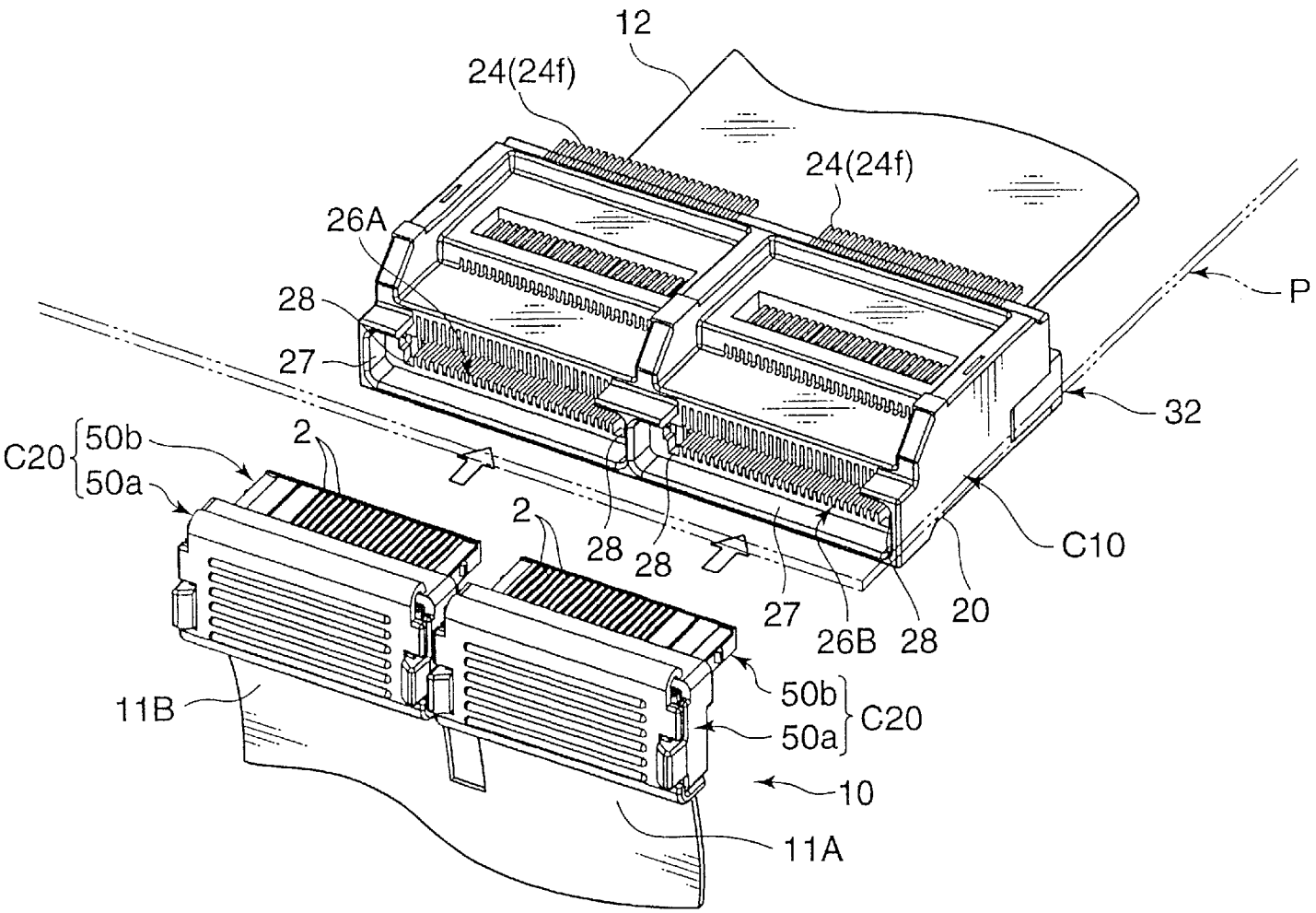
FIG. 1 is a perspective view showing a flat wire member connector using connector terminals in accordance with an embodiment of the invention.
Figure 2:
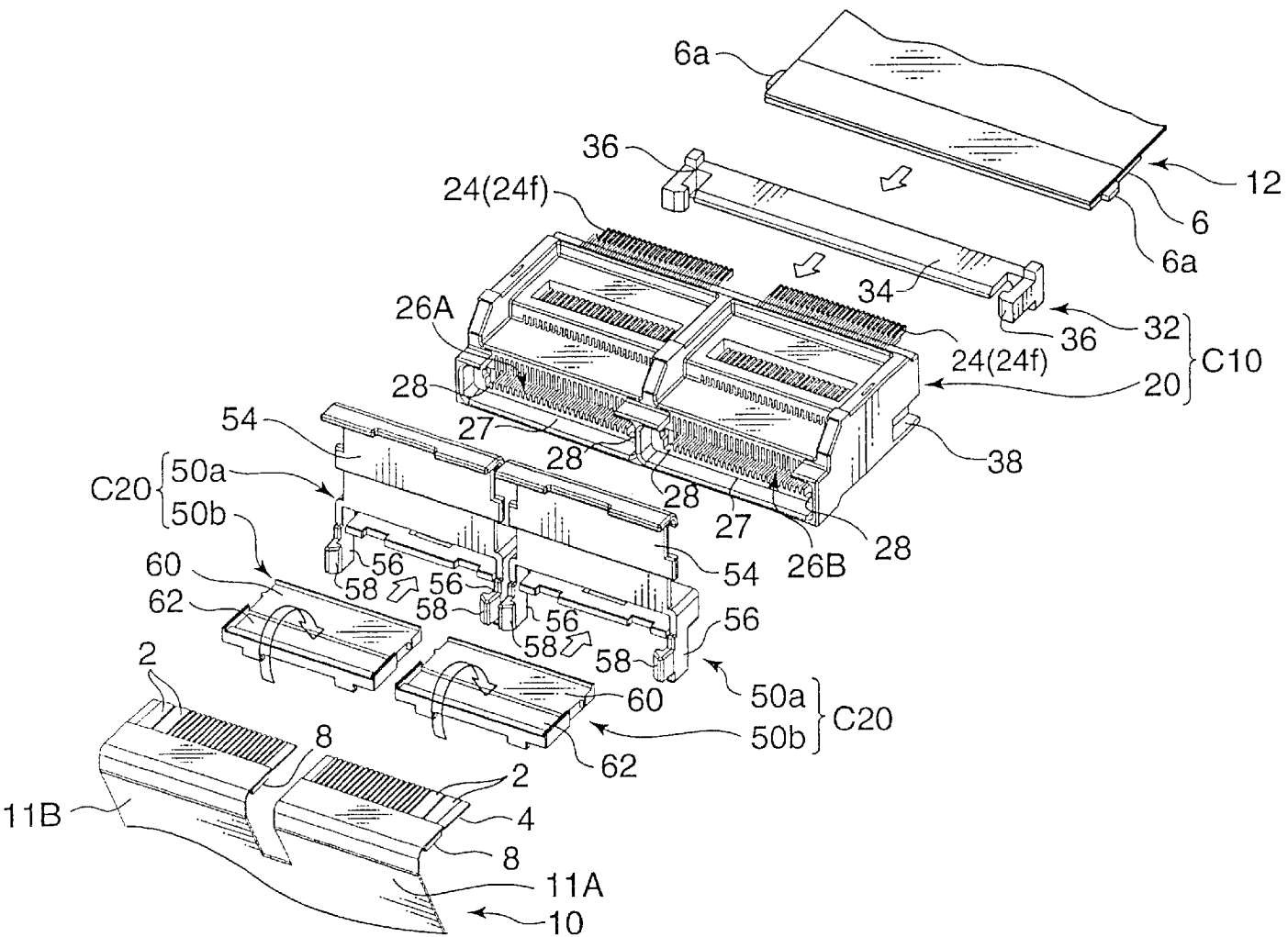
FIG. 2 is an exploded perspective view showing the flat wire member connector.
Figure 3A:
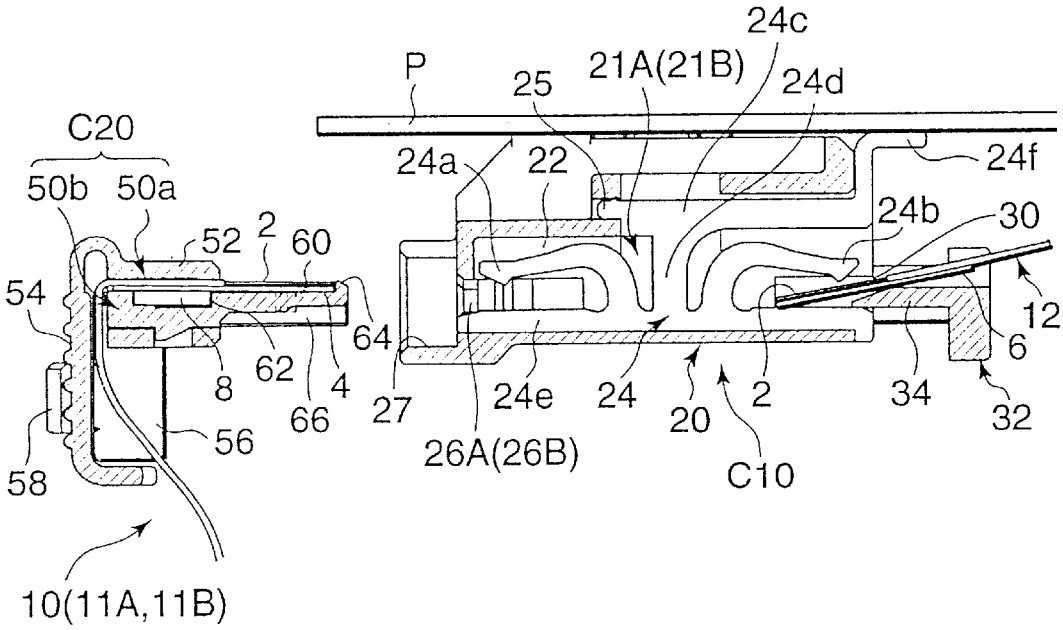

FIGS. 1, 2 and 3A schematically show a flat wire member connector provided with connector terminals in accordance with an embodiment of the present invention. A flat wire member connector C10 (hereinafter, "wire member connector C10") shown in these FIGURES is a circuit board connector of so-called two direction connection type which is constructed such that flat wire members are connectable with the front (left side in FIG. 3A) and rear sides thereof. The wire member connector C10 is mounted on the bottom surface of a circuit board P, and flat cables 10, 12 (hereinafter, "cables 10, 12") are connected as the flat wire members from front and behind in this embodiment.

Figure 6:
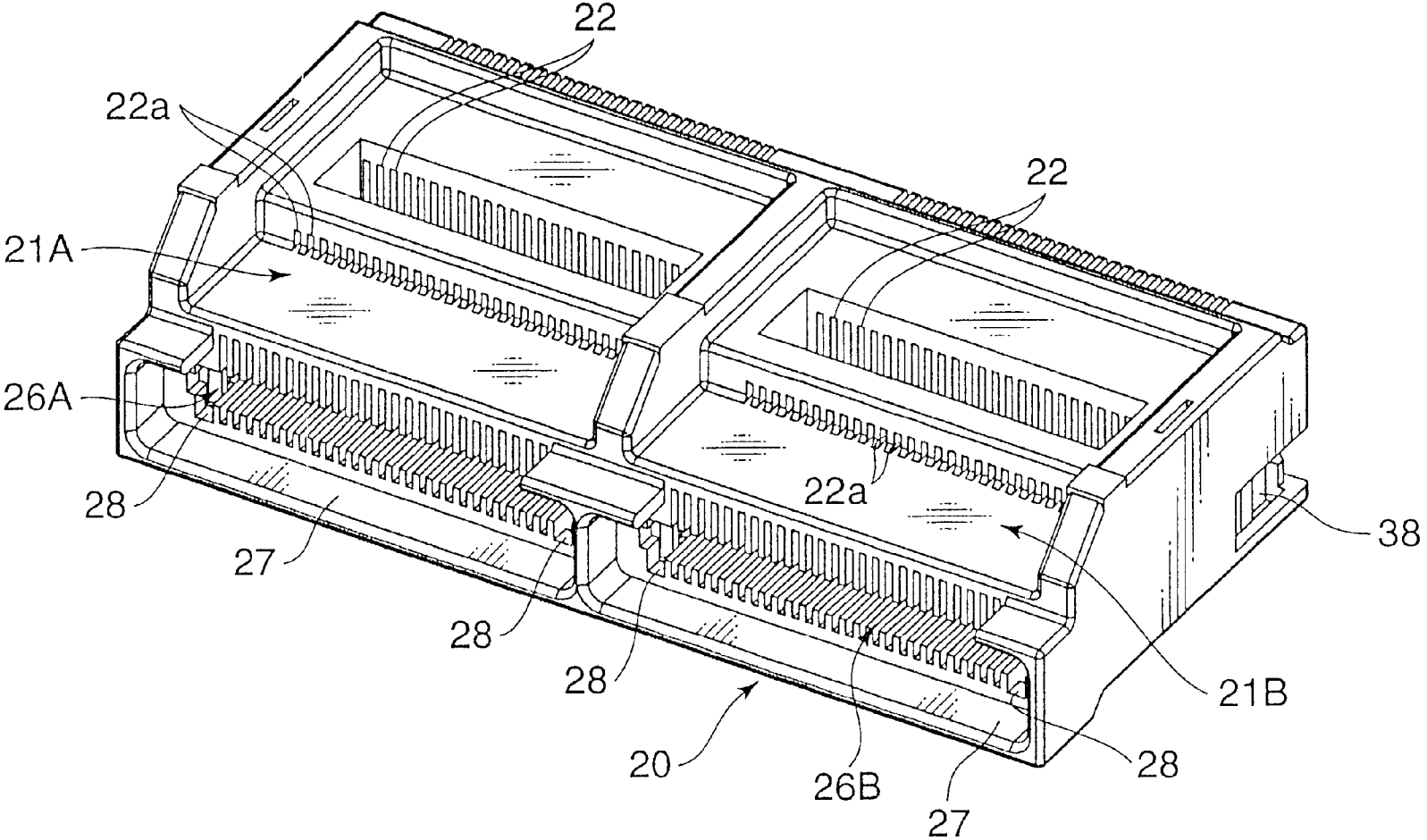
FIG. 6 is a perspective view showing a housing of the flat wire member connector.

More specifically, the wire member connector C10 includes a female housing 20 long and narrow in widthwise direction (direction normal to the plane of the drawing in FIG. 3A) as shown in FIG. 6.

Figure 5:
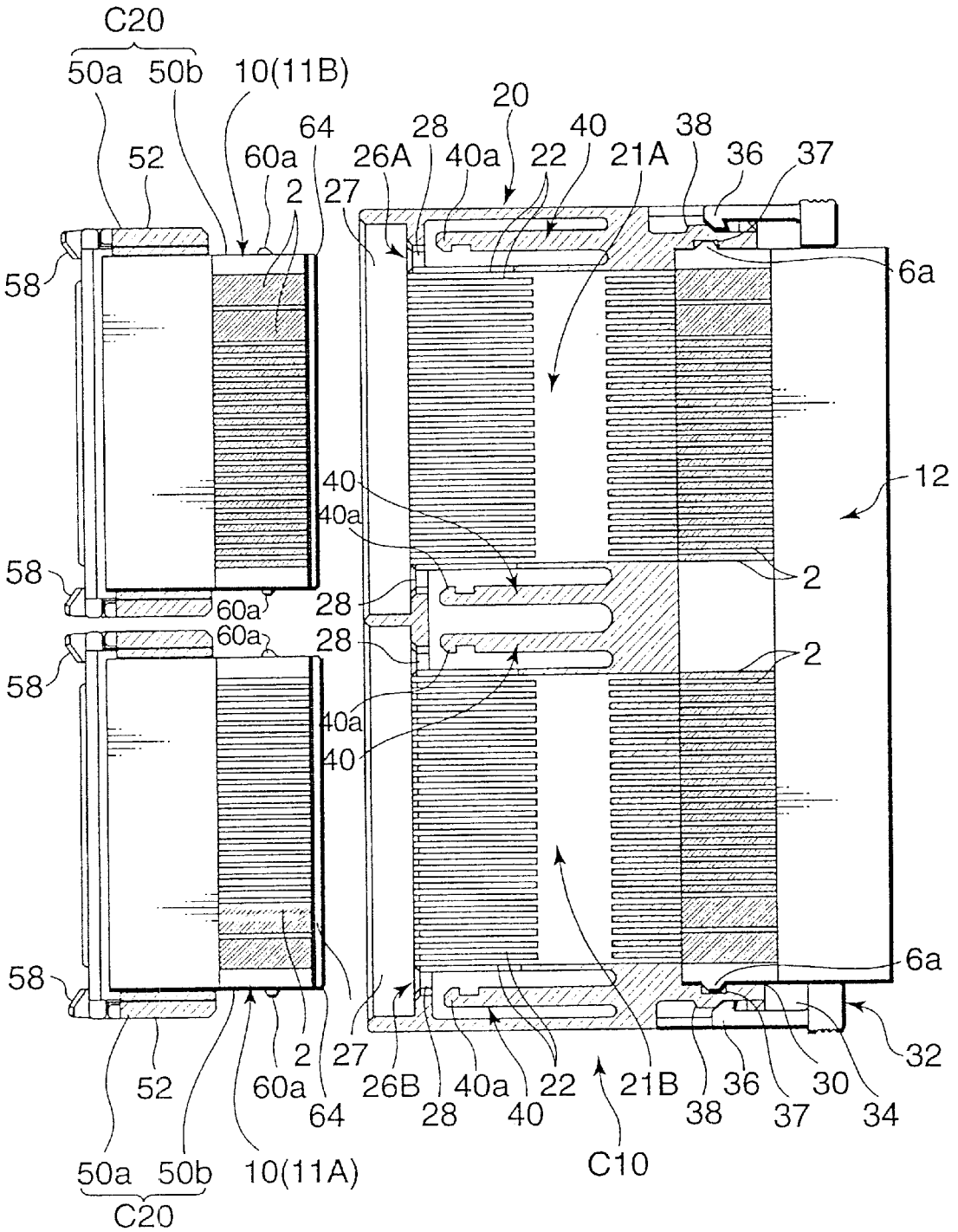
FIG. 5 is a sectional view showing a construction of the flat wire member connector, the flat wire member and the mating connector to be connected with the connector.

In the housing 20, two connection sections 21A, 21B are defined side by side in widthwise direction (vertical direction in FIG. 5) as shown in FIGS. 5 and 6. A plurality of cavities 22 having open front and rear ends are arrayed side by side in widthwise direction in each connection section 21A, 21B. Connector terminals 24 (hereinafter, "terminals 24") are accommodated in these cavities 22 (see FIG. 7B, the terminals 24 are not shown in FIG. 5).

Figure 7A:
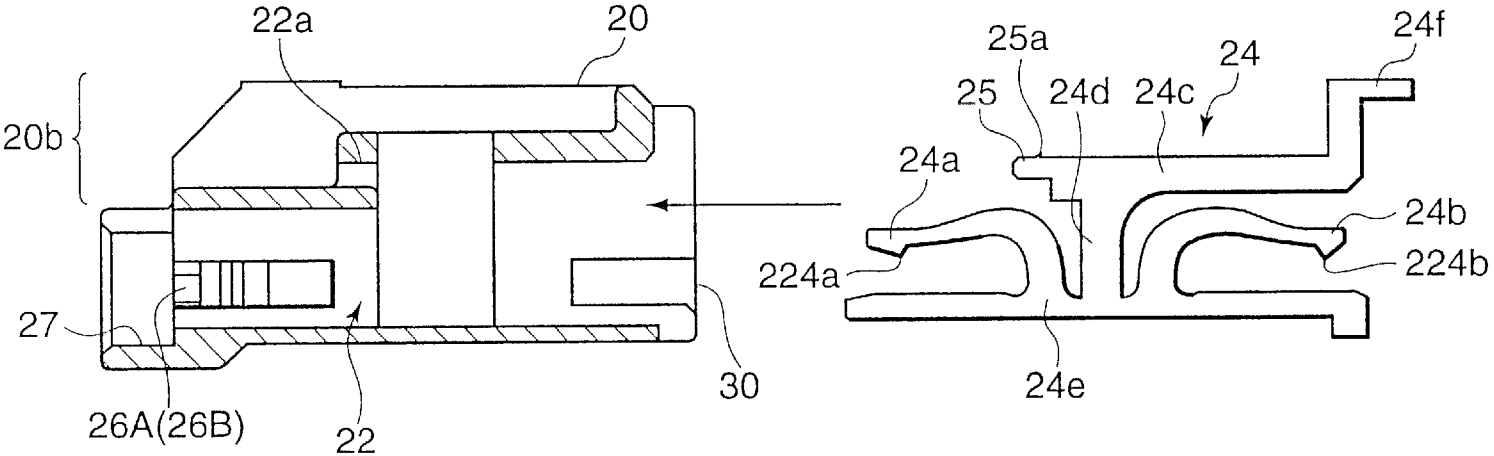
Figure 7B:
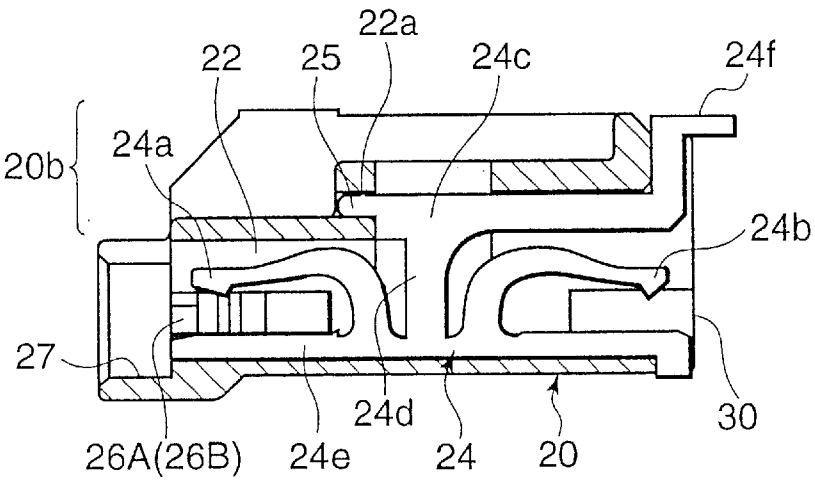

As shown in FIG. 7A, each terminal 24 is provided with a press-in portion 24*c* extending in forward and backward directions; a trunk portion 24*d* (joining portion) extending downward at a position near the leading end of the press-in portion 24*c;* a base portion 24*e* extending forward and backward from the bottom end (leading end) of the trunk portion 24*d;* a pair of deflectable pieces 24*a,* 24*d* for connection (contact portions) which are vertically resiliently displaceable, extend forward and backward from the base portion 24*e* at the front and rear sides of the trunk portion 24*d* and have contacts 224*a,* 224*d* at their sides opposite from the press-in portion 24*c;* and a leg portion 24*f* extending upward from the rear end of the press-in portion 24*c*. As. shown in FIG. 7A, the terminal 24 is inserted into the corresponding cavity 22 from behind the housing 20 while a leading end 25 of the press-in portion 24*c* is faced forward, and a hook 25*a* provided at the leading end 25 is engaged with the housing 20 with the leading end 25 pressed into a fixing hole 22*a* formed in the housing 20, whereby the terminal 24 is so accommodated or held as not to come out of the cavity 22 as shown in FIG. 7B. The leg portions 24*f* of the respective terminals 24 are soldered to a land or the like (not shown) on the circuit board P, thereby electrically connecting the terminals 24 with circuits on the circuit board P.

In order to facilitate the connection of the cables 10, 12, a raised portion 20*b* is provided at an upper part of the housing 20 to space insertion openings 26A, 26B and 30 for the cables 10, 12 to be described later from the circuit board P by a specified distance. The press-in portions 24*c* of the terminals 24 are pressed into the fixing holes 22*a* formed in this raised portion 20*b*. By pressing the press-in portions 24*c* into the raised portion 20*b,* the terminals 24 is reinforced by forming the press-in portions 24 wider in vertical direction to reinforce the terminals 24, whereas parts of the press-in portions 24*c* are rationally accommodated in the housing 20.

In the front surface of the housing 20, the insertion openings 26A, 26B for the cable 10 corresponding to the respective connection sections 21A, 21B are individually provided as shown in FIGS. 1, 3A and 5. During the connection of the cable 10, mating connectors C20 mounted on the cable 10 are inserted into the housing 20 through these insertion openings 26A, 26B, whereby conductors of the cable 10 are brought into contact with the front deflectable pieces 24*a* of the terminals 24.

Tubular hoods 27 are formed around the respective insertion openings 26A, 26B, and the mating connectors C20 are fitted into these hoods 27 during the connection of the cable 10. Further, guide grooves 28 for guiding the mating connector C20 are formed at the opposite widthwise ends of the respective insertion openings 26A, 26B.

On the other hand, the rear surface of the housing 20 is formed with an insertion opening 30 long and narrow in widthwise direction and common to the both connection sections 21A, 21B, and a slider 32 (supporting member) is insertably and detachably supported in this insertion opening 30.

As shown in FIG. 2, the slider 32 is a narrow member extending in the widthwise direction of the housing 20, and includes a tongue 34 extending in its longitudinal direction and fixing hooks 36 at its opposite ends. The slider 32 is inserted into the housing 20 through the insertion opening 30 together with the cable 12 while being placed on the cable 12, and is attached to the housing 20 by engaging the hooks 36 with projections 38 formed on the side walls of the housing 20, thereby fixing the cable 12 inserted into the wire member connector C10. A method for fixing the cable 12 is described in detail later.

Inside the housing 20 of the wire member connector C10, a pair of locking pieces 40 resiliently deflectable in widthwise direction are provided near the respective insertion openings 26A, 26B and at the opposite outer sides of the respective connection sections 21A, 21B as further shown in FIG. 5. Each locking piece 40 is provided with a hook 40*a* at its leading end (left end in FIG. 5). When the mating connectors C20 mounted on the cable 10 are inserted into the housing 20 through the respective insertion openings 26A, 26B, the hooks 40*a* are engaged with locking portions 60*a* of the mating connectors C20 to be described later.

On the other hand, the cables 10, 12 to be connected with the wire member connector C10 are respectively constructed as follows.

Figure 8A:
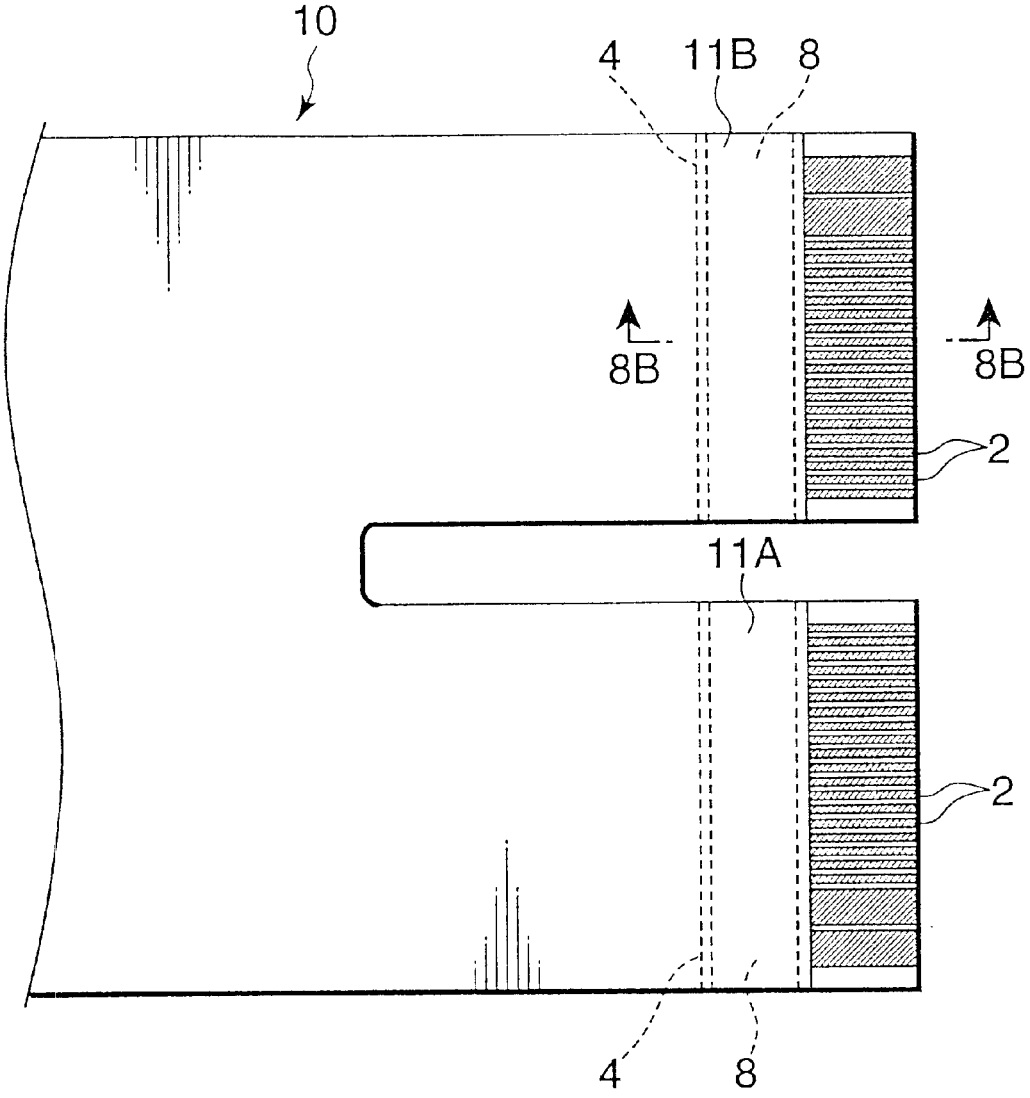
FIG. 8A is a plan view showing the construction of the flat wire member.
Figure 8B:
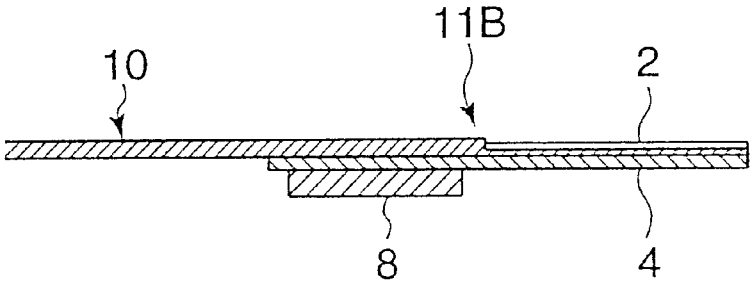
FIG. 8B is a sectional view taken along the line 8B—8B in FIG. 8A.

As shown in FIG. 8A, the cable 10 to be connected with the front side of the wire member connector C10 takes a forked structure by cutting away a middle portion (widthwise middle portion) of one end portion (right end portion in FIG. 8A) to split this end portion into split pieces 11A, 11B. The ends of the respective split pieces 11A, 11B are processed to expose conductors 2, and reinforcing plates 4 for restricting the deflection of the cable end portions are secured to the rear surfaces of these end portions. Further, positioning plates 8 are additionally secured to the reinforcing plates 4 at a position more backward (leftward in FIG. 8) than the exposed sections of the conductors 2.

As shown in FIGS. 1 and 2, the mating connectors C20 connectable with the wire member connector C10 are mounted on the end portions of the respective split pieces 11A, 11B.

Figure 9A:
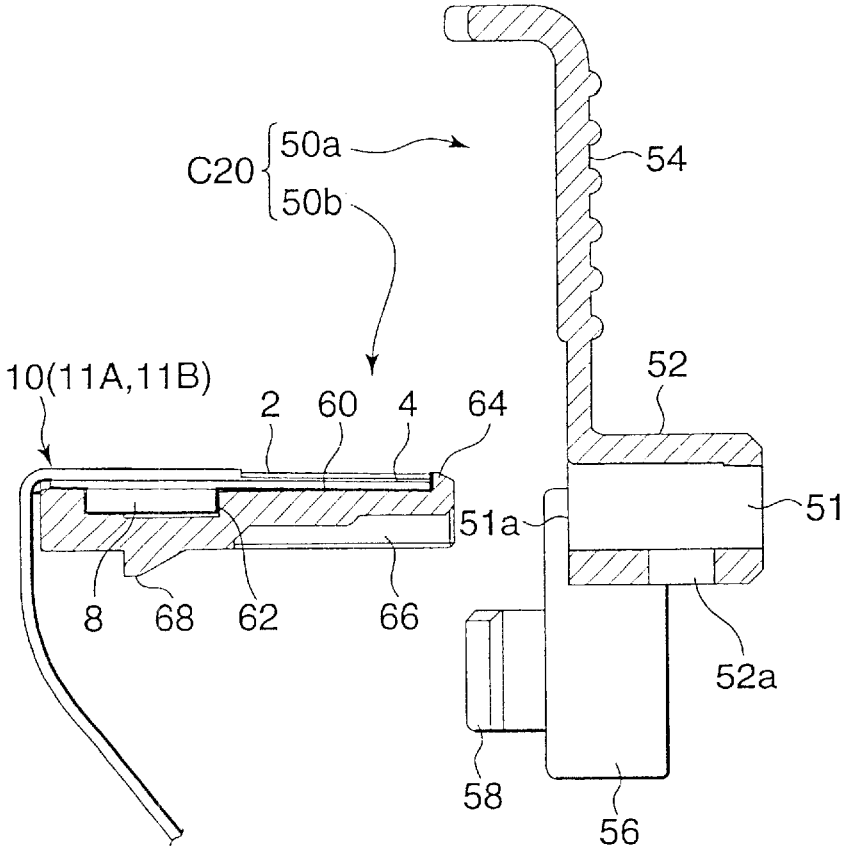

Each mating connector C20 is comprised of a housing 50*a* and a holder 50*b* as shown in FIGS. 2 and 9A, and is mountable on the end of the split piece 11A (11B) by inserting the holder 50*b* into the housing 50*a* while placing the holder 50*b* on the split piece 11A (11B).

Specifically, the housing 50*a* has a tubular shell portion 52 formed with an insertion hole 51 long and narrow in widthwise direction and penetrating in forward and backward directions (transverse direction in FIG. 9A) into which hole the holder 50*b* and the like are insertable. This shell portion 52 is provided with a vertically foldable (bendable) lock piece 54 in the form of a thin plate and serving as a handle portion at its rear end (left end in FIG. 9A) and at an upper part of an insertion opening 51*a* of the holder 50*b*. Further, a pair of leg portions 56 having hooks 58 engageable with the lock piece 54 are provided at the opposite widthwise ends of the shell portion 52.

Figure 10:
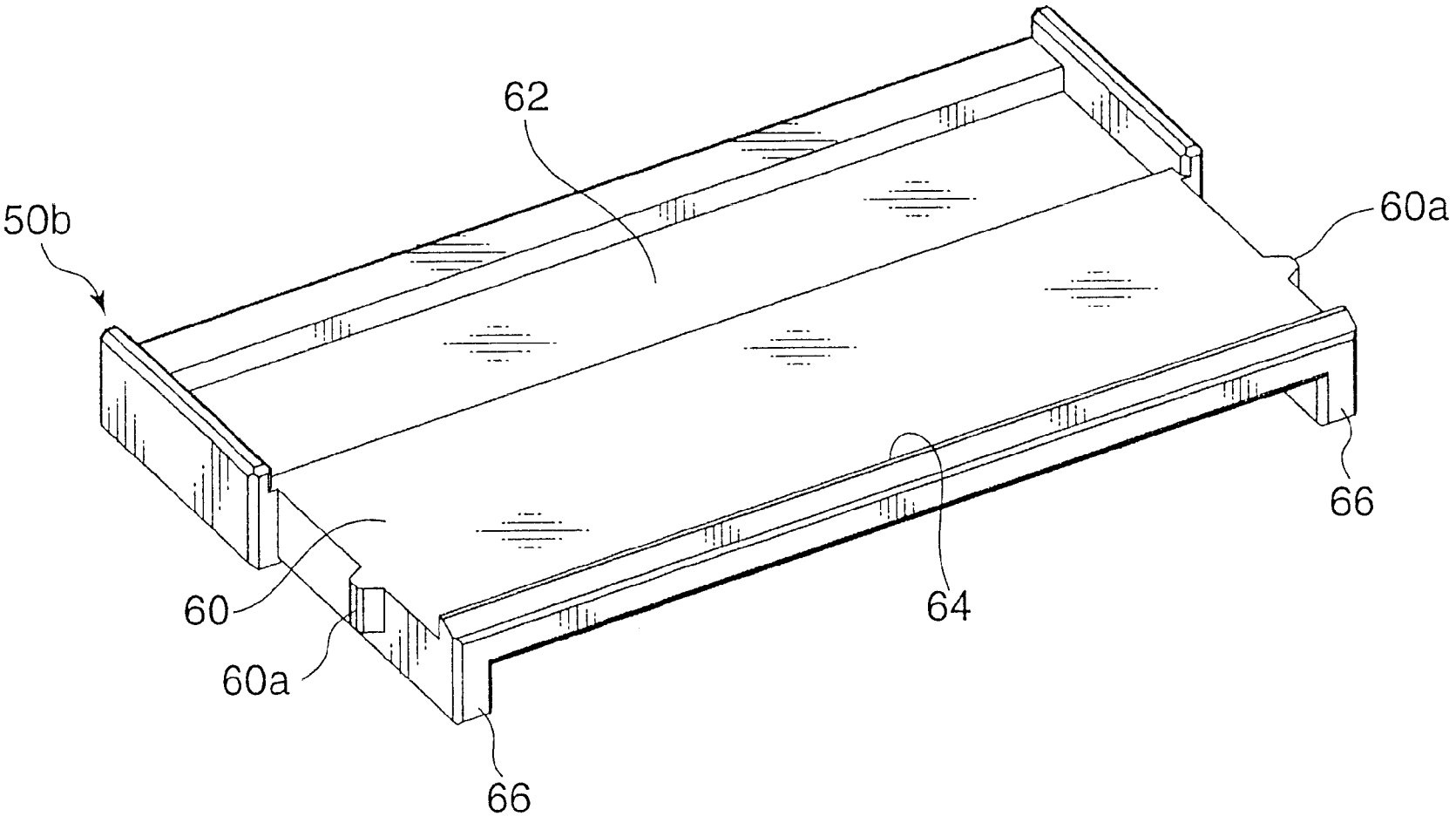
FIG. 10 is a perspective view showing a holder of the mating connector.

On the other hand, the holder 50*b* is a plate member having a flat alignment surface 60 on top as shown in FIG. 10, and is placed on the rear surface (reinforcing plate 4) of the split piece 11A(11B) via the alignment surface 60. A positioning recess 62 is formed at a rear part (left part in FIG. 9A) of the alignment surface 60 in order to restrict a displacement of the split piece 11A(11B) and the holder 50*b* by fitting the positioning plate 8 of the split piece 11A(11B) into the recess 62. An interference preventing rib 64 for protecting the cable 10 from turning-up of the conductors 2 and the like caused by an interference during connection is formed at the leading end (right end in FIG. 9A) of the holder 50*b*.

The mating connector C20 is mounted on the split piece 11A(11B) as follows. The holder 50*b* is placed on the rear surface of the split piece 11A(11B) via the alignment surface 60 as shown in FIG. 9A, and the split piece 11A(11B) is inserted together with the holder 50*b* into the insertion hole 51 of the housing 50*a* from its leading end (i.e., from the rib 64 of the holder 50*b*) in this state. Then, the lock piece 54 is so bent as to close the insertion opening 51*a* of the housing 50*a,* and is locked by being pushed between the two hooks 58. In this way, each mating connector C20 is mounted on the split piece 11A(11B).

Figure 9B:
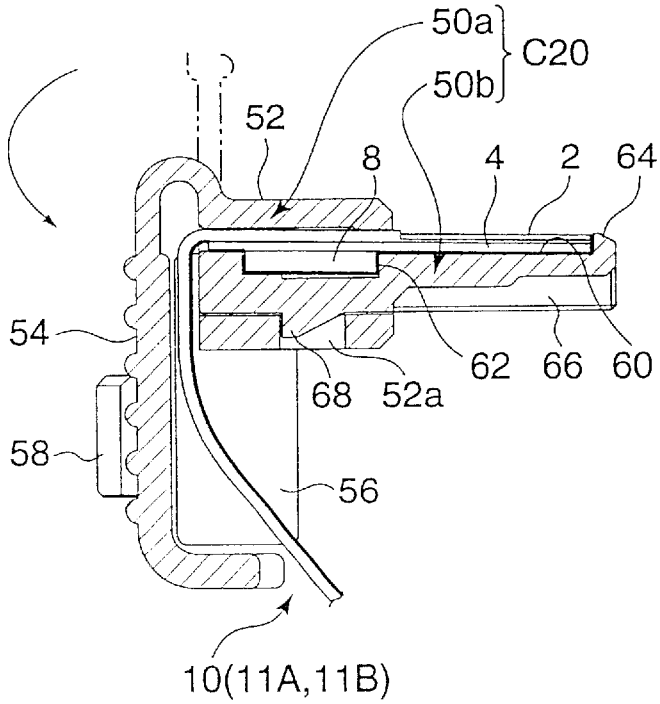

With the mating connector C20 mounted on the split piece 11A(11B), the exposed sections of the conductors 2 at the end of the split piece 11A(11B) are supported together with the holder 50*b* while projecting from the opposite side of the shell portion 52 of the housing 50*a* as shown in FIG. 9B. Further, as shown in FIG. 9B, a hook 68 formed on the rear surface of the holder 50*b* is engaged with a locking hole 52*a* formed in the inner bottom wall of the shell portion 52 of the housing 50*a,* with the result that the holder 50*b* is doubly locked in the housing 50*a* in cooperation with the lock piece 54 so as not to come out of the housing 50*a*.

The locking portions 60*a* project at the opposite widthwise ends of the holder 50*b* of the mating connector C20 as shown in FIG. 10, and a pair of guides 66 which are intermediate molded portions extending in forward and backward directions (transverse direction in FIG. 9A) are provided at the opposite widthwise ends of the rear surface of the holder 50*b*.

Figure 11A:
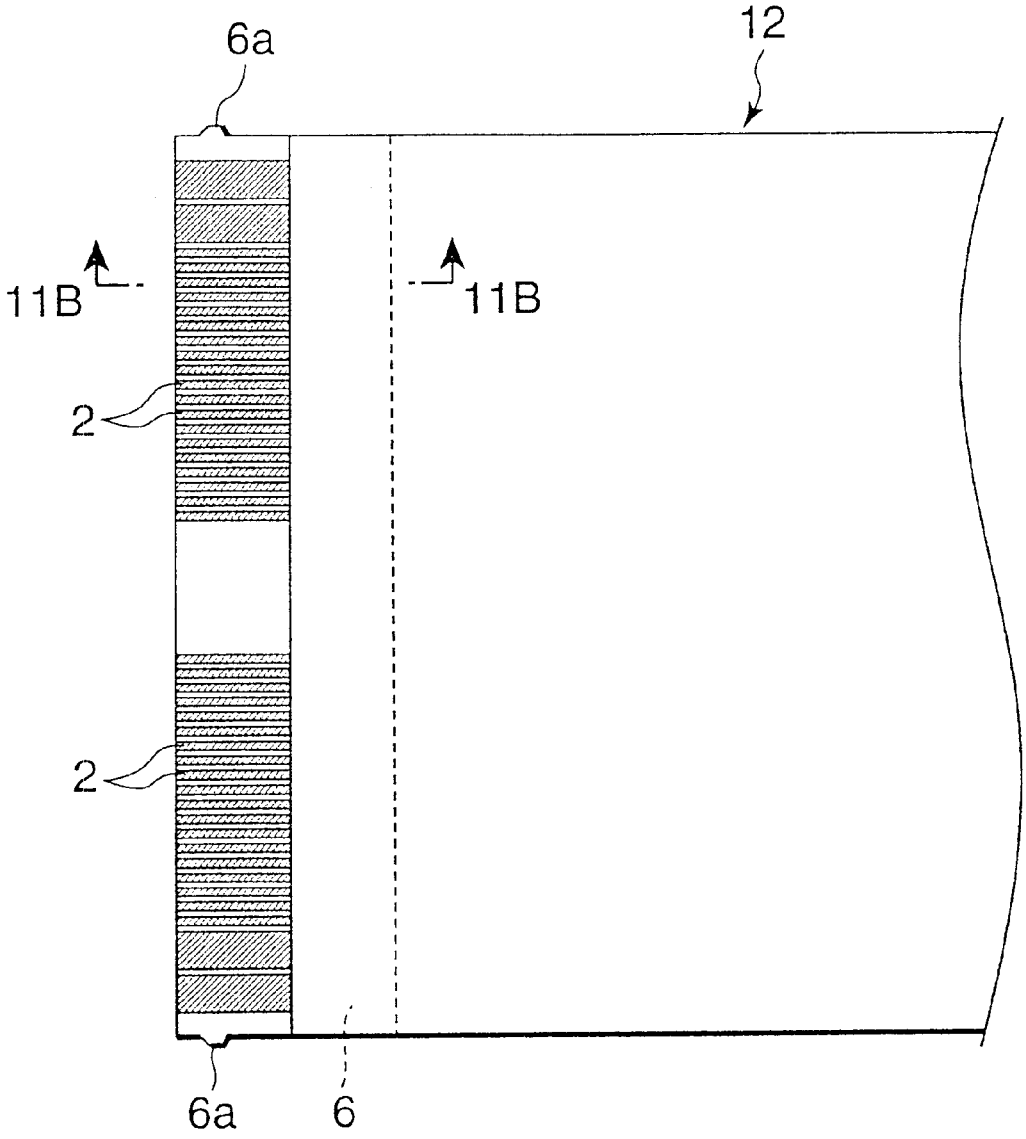
FIG. 11A is a plan view showing the construction of the flat wire member.
Figure 11B:
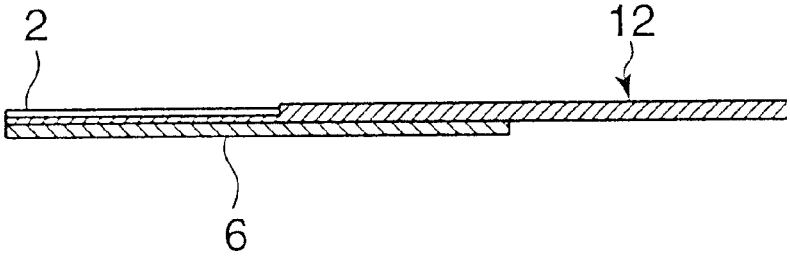
FIG. 11B is a sectional view taken along the line 11B—11B of FIG. 11A.

On the other hand, the cable 12 to be connected with the rear side of the wire member connector 10 is, as shown in FIGS. 11A and 11B, such that its end portion is processed to expose the respective conductors 2 and a reinforcing plate 6 for restricting a deflection of the cable end is secured to the rear surface of the cable end. Although the conductors 2 are originally present at its middle portion (widthwise middle portion), unnecessary conductors 2 at the middle portion are omitted so as to conform to the cable 10.

In the above construction, the cables 10, 12 are connected with the wire member connector C10 as follows.

Figure 3B:
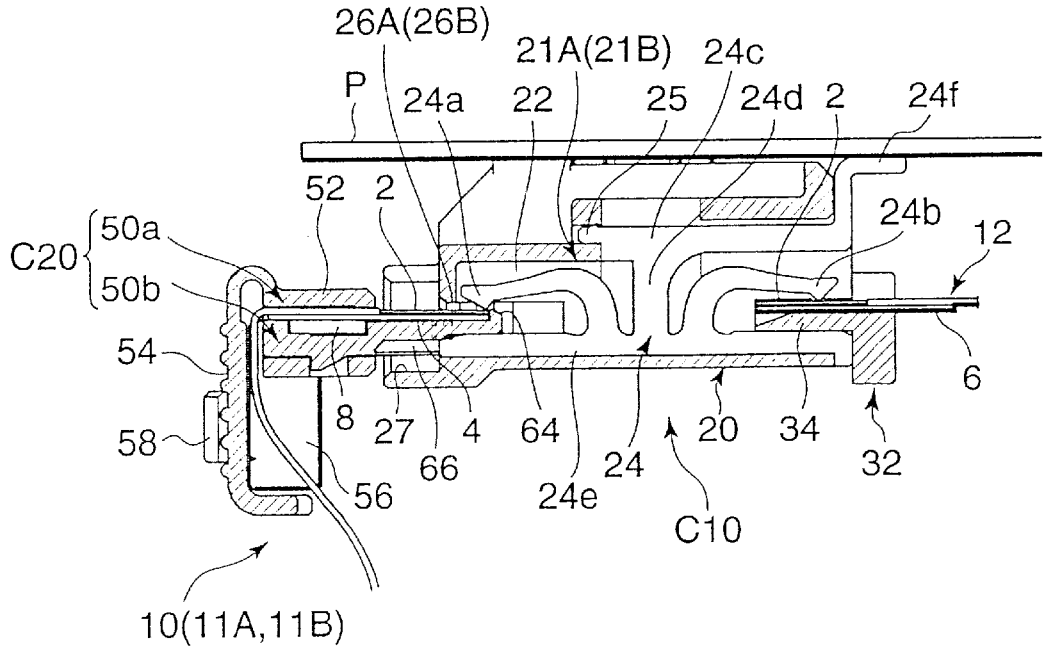

First, the cable 12 is connected with the wire member connector C10 as follows. The end portion of the cable 12 is loosely inserted into the housing 20 through the rear insertion opening 30 as shown in FIG. 3A, and thereafter the slider 32 is inserted into the housing 20 through the insertion opening 30 as shown in FIG. 3B. By doing so, the end portion of the cable 12 is pushed up by the tongue 34 of the slider 32 while being inserted between the deflectable pieces 24*d* and the base portions 24*e* of the terminals 24, whereby the conductors 2 of the cable 12 are brought into contact with the deflectable pieces 24*d* of the terminals 24 accommodated in the respective connection sections 21A, 21B. By the contact with the terminals 24, the respective conductors 2 of the cable 12 are connected with the circuits on the circuit board P via the terminals 24.

Partial locking projections 6*a* are formed at the opposite widthwise ends of the reinforcing plate 6 of the cable 12 as shown in FIG. 11A. When the end portion of the cable 12 is loosely inserted into the housing 20 through the insertion opening 30 (state shown in FIG. 3A), the cable 12 can be partly locked in the housing 20 until the slider 32 is inserted by engaging the projections 6*a* with recesses 37 formed in the inner surfaces of the side walls of the housing 20 (see FIG. 5).

Figure 12A:
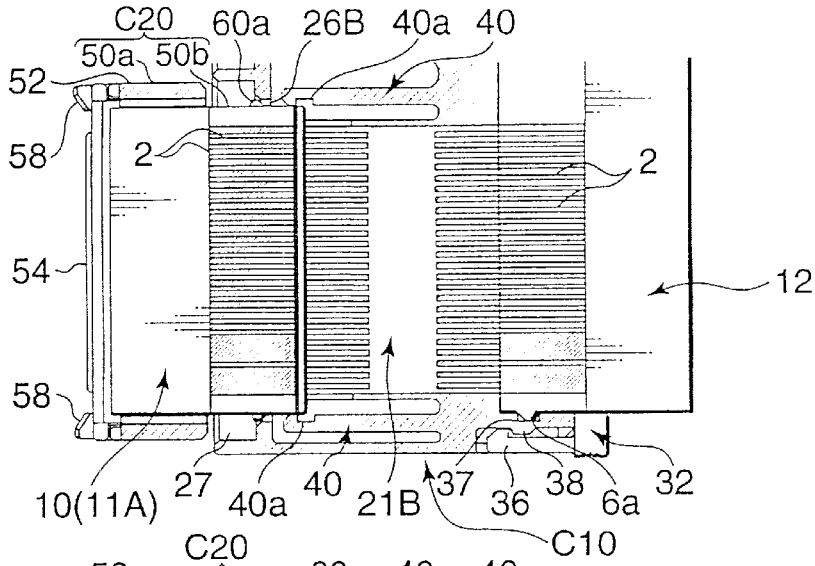
FIGS. 12A, 12B and 12C are sectional views, respectively corresponding to FIGS. 3B, 4A and 4B, showing the constructions of the flat wire member connector, the flat wire member and the mating connector to be connected with this connector.

On the other hand, the cable 10 is connected with the wire member connector C10 as follows. The respective mating connectors C20 of the cable 10 are opposed to the respective insertion openings 26A, 26B of the wire member connector C10, and the projecting portions of the holders 50*b* of the respective mating connectors C20 are inserted through the insertion openings 26A, 26B from their leading ends as shown in FIGS. 3B and 12A. At this time, the mating connectors C20 are inserted through the insertion openings 26A, 26B while the guides 66 of the holders 50*b* are guided along the guide grooves 28 formed in the insertion openings 26A, 26B.

Figure 4A:
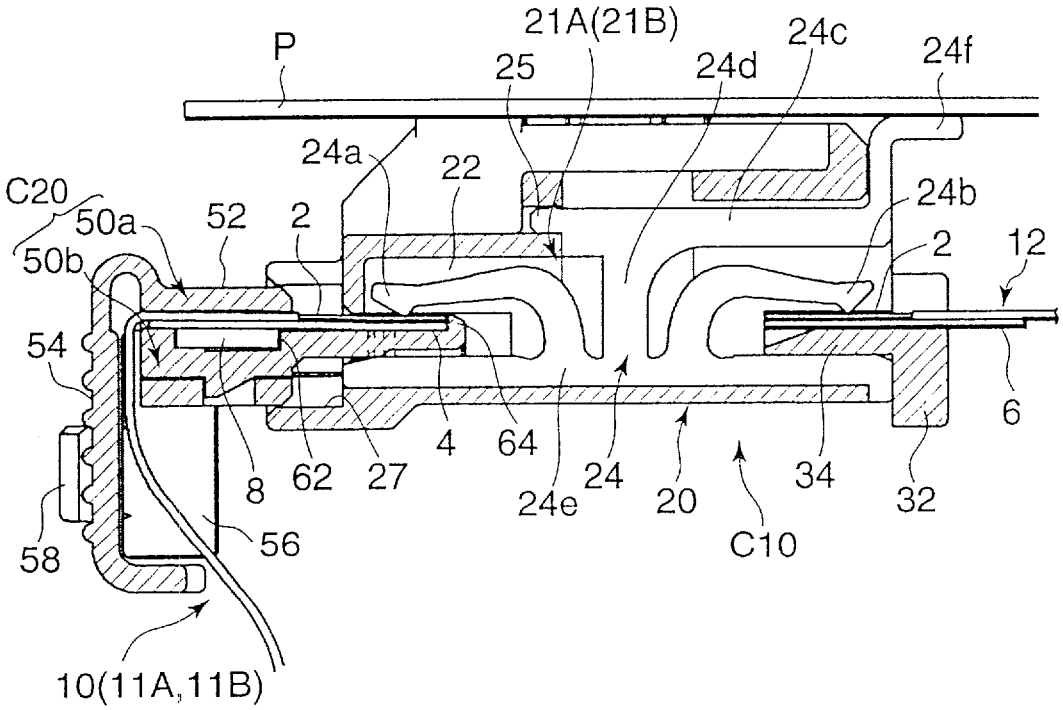
Figure 4B:
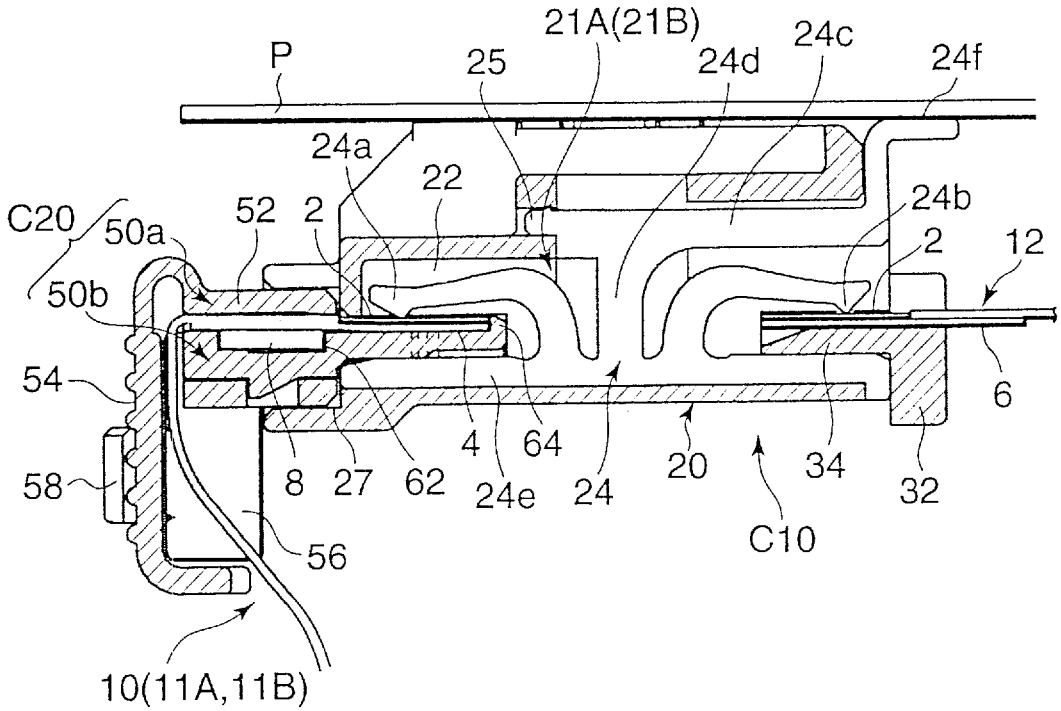
Figure 12B:
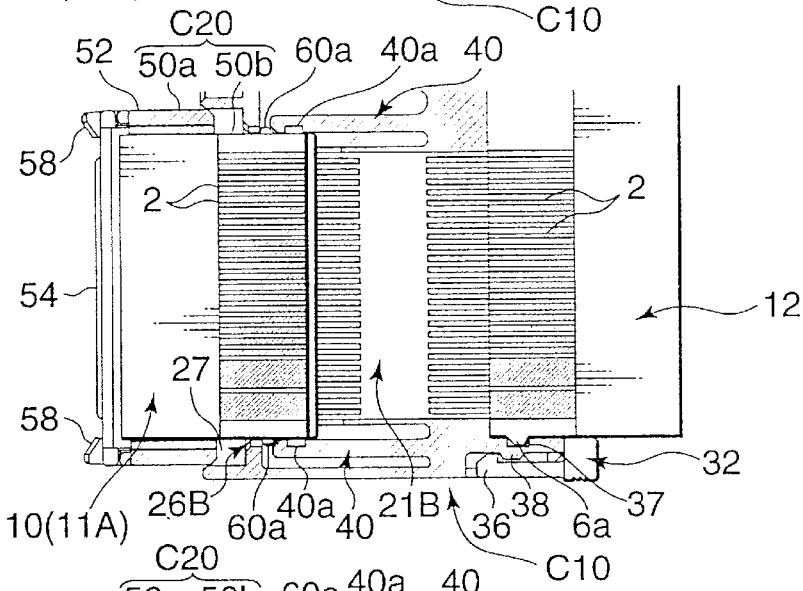
Figure 12C:
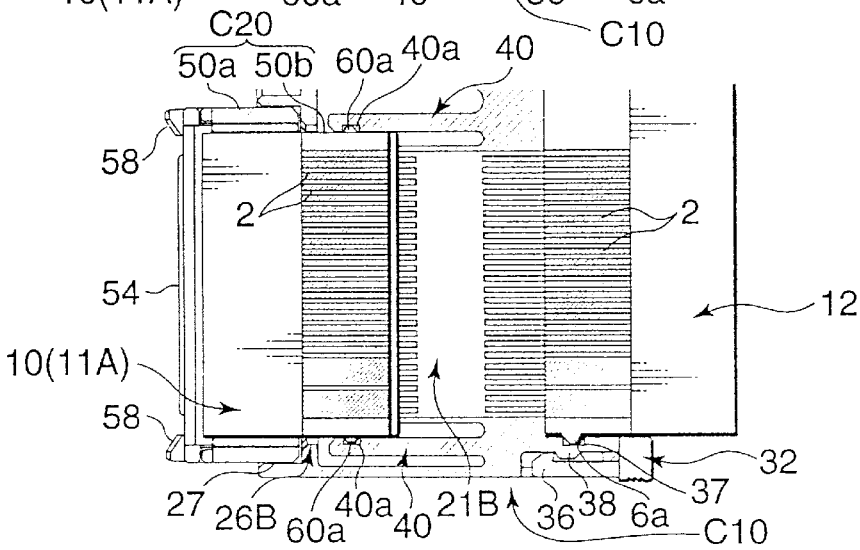

In this way, the housings 50*a* (shell portions 52) of the respective mating connectors C20 are fitted into the hoods 27 of the wire member connector C10, i.e., a state shown in FIGS. 4A and 12B changes to a state shown in FIGS. 4B and 12C. As the mating connector C20 is inserted, a pair of locking pieces 40 inside the wire member connector C10 are pushed wider apart by the locking portions 60*a* formed on the holder 50*b*. When the holder 50*b* is inserted to the back end of the mating connector C20, the hooks 40*a* of the respective locking pieces 40 are engaged with the corresponding locking portions 60*a* of the holder 50*b,* with the result that each mating connector C20 is locked into the wire member connector C10. Each locking portion 60*a* of the holder 50*b* is formed into such a substantially trapezoidal shape in plan view which is tapered from its base end toward its leading end. Accordingly, this locked state is a so-called "semi-locked" state and, when being pulled in a withdrawing direction with a specified force or larger, the mating connector C20 can be detached from the wire member connector C10 while being unlocked.

When the mating connectors C20 are thus connected with the wire member connector C10, the exposed sections of the conductors 2 of the cable 10 are inserted into the connection sections 21A, 21B of the wire member connector C10 together with the holders 50*b,* thereby being brought into contact with the deflectable pieces 24*a* of the respective terminals 24. By this contact, the respective conductors 2 of the cable 10 are connected with the circuits of the circuit board P via the terminals 24, and corresponding pairs of the conductors 2 of the cable 12 connected with the rear side of the wire member connector C10 and those of the cable 10 are connected via the terminals 24.

The wire member connector C10 as above have following effects since adopting the terminals 24 of the aforementioned shape.

First, the plastic deformation of the deflectable pieces 24*a,* 24*d* during the insertion of the terminals 24 into the housings 20 can be effectively prevented. Specifically, since the leading ends 25 of the press-in portions 24*c* are pressed into the fixing holes 22*a* during the insertion of the terminals 24 into the housing 20, a compression load acts on the terminals 24 at this time. However, as described above, the contact portions, i.e., the deflectable pieces 24*a,* 24*d* are displaced downward from the press-in portion 24*c* via the trunk portion 24*d* in the terminals 24. Thus, if the terminal 24 is inserted into the housing 20 with the rear end of the press-in portion 24*c* held, the compression load acts only on the press-in portion 24*c* without acting on the deflectable pieces 24*a,* 24*d.* Therefore, an undesirable event where the deflectable pieces 24*a,* 24*d* are deflected and deformed (plastic deformation) by the compression load acting during the insertion can be effectively prevented. As a result, occurrences of a contact failure and the like resulting from the deformation of the deflectable pieces 24*a,* 24*d* can be effectively avoided.

In this terminal 24, the leg portion 24*f* (contact portion with the circuit board) at the rear end of the press-in portion 24*c* is soldered to the circuit board P to thereby electrically connect the terminal 24 with the circuit board P. Thus, there is an effect of realizing a rational construction in which the press-in portion 24*c* also serves as the contact portion with the circuit board P.

The terminal 24 is also provided with the base portion 24*e* extending forward and backward from the leading end (bottom end) of the trunk base 24*d,* and the deflectable piece 24*d* having the contact 224*d* at its side opposite from the press-in portion 24*c* is formed between the base portion 24*e* and the press-in portion 24*c.* As a result, upon connecting the cable 12 with the wire member connector C10, the slider 32 can be inserted into the housing 20 at the side of the cable 12 opposite from the circuit board P, i.e., below the cable 12 as shown in FIGS. 3A and 3B, thus providing an effect of facilitating the connection of the cable 12. Specifically, instead of providing the deflectable piece 24*d* with the contact 224*d,* a contact may be provided at the side of the base portion 24*e* toward the press-in portion 24*c.* However, in such a case, since the cable 12 needs to be inserted with the conductors 2 faced toward the base portion 24*e,* the slider 32 inevitably needs to be inserted into the housing 20 between the circuit board P and the cable 12. Thus, the slider inserting operation is difficult to perform because it needs to be done at a position very proximate to the circuit board P without seeing the slider 32 (i.e., the slider 32 cannot be seen by being blocked by the cable 12). Contrary to this, with the terminal 24 in which the contact 224*d* is provided at the deflectable piece 24*d* as in this embodiment, the slider 32 can be inserted below the cable 12. As a result, the slider 32 can be inserted at a position distanced from the circuit board P while being seen and, therefore, the cable 12 can be securely and easily connected.

Figure 13:
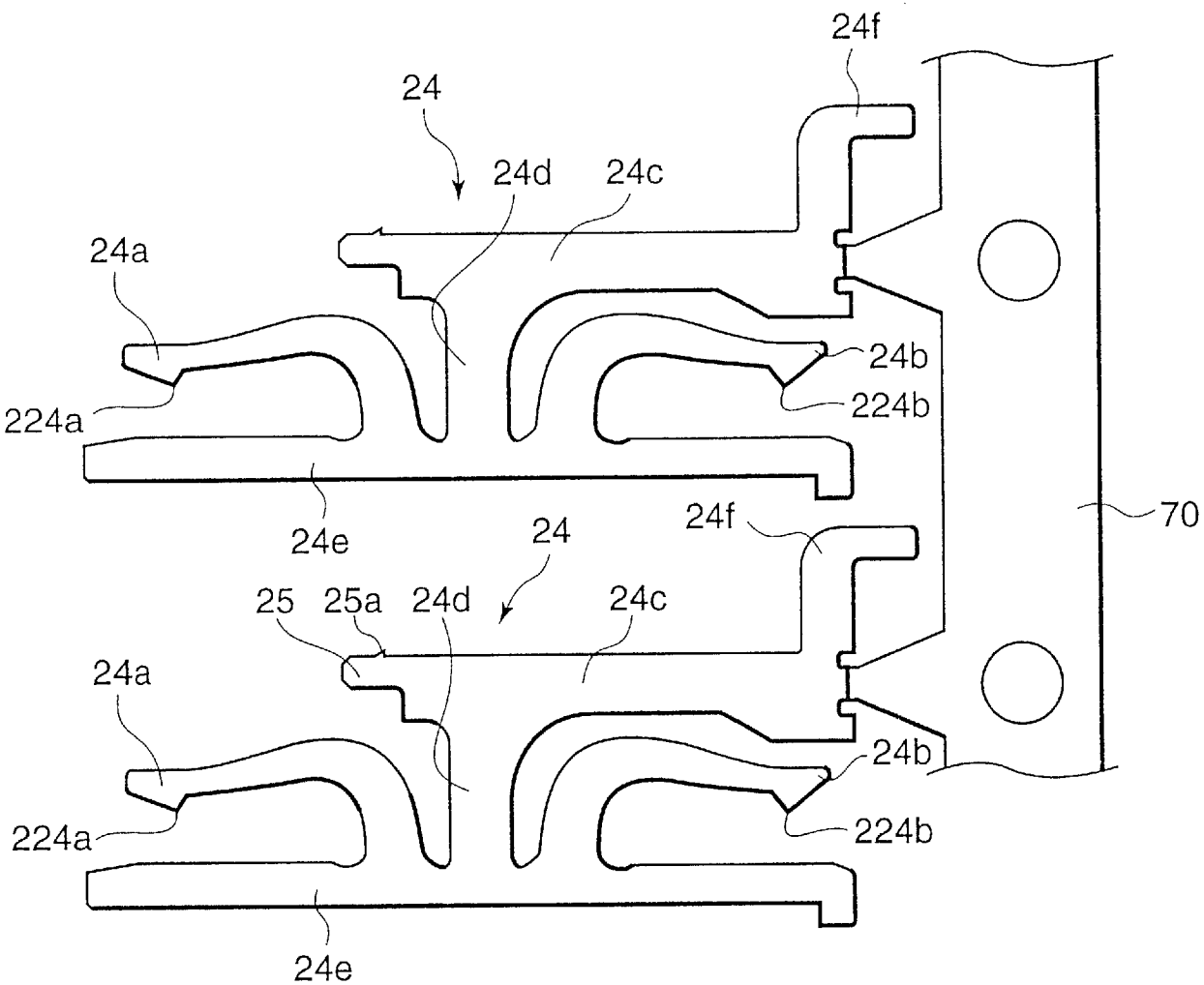
FIG. 13 is a diagram showing a state where the connector terminals are connected with a carrier.

The terminals 24 used in the wire member connector C10 as above can be produced by stamping a thin metallic plate out by a press as general terminals of this type are. It is preferable to produce the terminals 24, for example, in such a state as shown in FIG. 13. In other words, it is preferable to produce the terminals while arraying a plurality of terminals 24 in a row along a strip-shaped carrier (carrier member 70) and separably connecting the rear ends of the press-in portions 24*c* of the respective terminals 24 (rear ends of the terminals 24 with respect to the inserting direction thereof into the housing 20) with the carrier member 70 as shown in FIG. 13.

By forming the terminals 24 as above, the terminals 24 can be inserted into the housing 20 as follows. The terminal 24 is inserted up to the back end of the housing 20 from the leading end 25 of the press-in portion 24*c* with the carrier member 70 held, and then the carrier member 70 is bent to separate the terminal 24 therefrom. Accordingly, the terminal 24 can be inserted into the housing 20 while the rear end of the terminal 24 (press-in portion 24*c*) is securely held via the carrier member 70. Therefore, there is an effect of securely and easily inserting the terminal 24 into the housing 20 even if the terminal 24 is very small and is difficult to singly hold.

It should be appreciated that the wire member connector C10 described in the above embodiment is only an example of the flat wire member connector to which the connector terminals (terminals 24) according to the present invention are applied, and the specific constructions of the connector terminals and the flat wire member connector can be suitably changed without departing the scope of the present invention.

For example, although the wire member connector C10 is secured to the lower surface of the circuit board P, it may be secured to the upper surface of the circuit board P. In such a case, the leg portion 24*f* of the terminal 24 may be provided at the rear end of the base portion 24*e* instead of being provided at the rear end of the press-in portion 24*c* and the wire member connector C10 may be secured to the upper surface of the circuit board P via the lower surface (surface at the lower side in FIG. 3) of the leg portion 24*f.*

In the wire member connector C10, the housings 20 of the mating connectors C20 are connected with the front side and the cable 12 is directly inserted at the rear side. However, the connecting constructions of the cables (flat wire members) at the front and rear sides of the wire member connector C10 may be reversed. Further, besides adopting the different connecting constructions at the front and rear sides of the connector as in the foregoing embodiment, the same connecting construction may be adopted at the front and rear sides.

Although the flat cables 10, 12 are used as flat wire members in the foregoing embodiment, the flat wire members are not limited to flat cables. Ribbon wires, FPCs (flexible printed circuits) and the like may be used as such.

As described above, an inventive connector terminal is accommodated in a connector housing of a flat wire member connector of two-direction connection type having insertion openings for flat wire members provided at its front and rear sides. The connector terminal comprises a press-in portion which extends in forward and backward directions and is to be pressed into a fixing hole formed in the connector housing from the front end side thereof; and a pair of front and rear contact portions provided at positions vertically displaced from the press-in portion to be brought into contact with the flat wire members. The contact portions are joined to the press-in portion via a portion between the contact portions.

In the connector terminal thus constructed, the contact portions are vertically displaced from the press-in portion.

Thus, if the connector terminal is inserted into the connector housing with the rear end of the press-in portion held, a compression load acts only on the press-in portion without acting on the contact portions. Therefore, the contact portions can be effectively prevented from undergoing a deformation (plastic deformation) during the insertion of the connector terminal into the connector housing.

In the case that the flat wire member connector is a circuit board connector to be secured to a circuit board, a contact portion to be brought into contact with the circuit board is preferably provided at the press-in portion of the connector terminal. This enables realization of a rational construction in which the press-in portion also serves as the contact portion with the circuit board.

In this case, preferably, a base portion extending in forward and backward directions and joined to the press-in portion, and deflectable pieces provided between the base portion and the press-in portion and extending forward and backward from the base portion at the opposite sides of a portion joining the base portion and the press-in portion are provided as the contact portions, and the flat wire members are insertable between the deflectable pieces and the base portion.

With such a construction, the connector terminal can be securely brought into contact with the flat wire members by the resilient deflection of the deflectable pieces while being firmly held in the connector housing by the press-in portion and the base portion.

A contact to be brought into contact with the corresponding flat wire member is preferably provided on a side of each deflectable piece opposite from the press-in portion in the case of the flat wire member connector in which the flat wire member is held in the connector housing by being inserted through the insertion opening with a supporting member placed thereon.

This construction has an advantage of facilitating the insertion of the supporting member since the supporting member can be inserted into the connector housing (through the insertion opening) at the side of the flat wire member opposite from the circuit board.

Further, in the case that the connector housing is provided with a raised portion for locating the insertion openings for the flat wire members at positions distanced from the circuit board, the press-in portion is preferably pressed into the raised portion of the connector housing. Then, the connector terminal can be reinforced by forming the press-in portion wider in vertical direction, whereas the press-in portion can be rationally accommodated in the connector housing utilizing the raised portion.

The above connector terminals are formed by stamping a thin metallic material by a press. According to a preferred method, a plurality of connector terminals are formed while being arrayed in a row along a strip-shaped carrier such that press-in portions of the respective connector terminals are separably connected with the carrier at the rear ends thereof with respect to the inserting direction of the connector terminals into a connector housing.

With such a producing method, the connector terminal is inserted into the housing with the carrier held, and then the carrier is bent with respect to the connector terminal to separate the connector terminal therefrom. In this way, the terminal can be inserted into the housing while being securely held via the carrier. Therefore, the connector terminal can be easily inserted even if it is very small.

In the connector terminal producing process, a plurality of connector terminals are formed such that the press-in portions thereof are separably connected with the carrier at the rear ends thereof with respect to the inserting direction of the connector terminals into the connector while being array in a row along the striped-shaped carrier. Thus, the connector terminals can be inserted into the connector housing while being securely held via the carrier, with the result that the operability of inserting the connector terminals can be improved.

This application is based on patent application No. 2001-48130 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A connector terminal to be accommodated in a connector housing of a flat wire member connector of two-directional connection type having insertion openings provided at its front and rear sides for receiving flat wire members, the flat wire member connector being a circuit board connector to be secured to a circuit board, the connector terminal comprising:

a press-in portion which extends in forward and backward directions and is to be pressed into a fixing hole formed in the connector housing from the front end side thereof;

a pair of front and rear contact portions provided at positions vertically displaced from the press-in portion to be brought into contact with the flat wire members, the contact portions being joined to the press-in portion via a portion between the contact portions; and a contact portion provided at the press-in portion of the connector terminal to be brought into contact with the circuit board.

2. A connector terminal according to claim 1, wherein the contact portion includes a base portion extending in forward and backward directions and joined to the press-in portion, and deflectable pieces provided between the base portion and the press-in portion and extending forward and backward from the base portion at the opposite sides of a portion joining the base portion and the press-in portion, and the flat wire member are insertable between the deflectable pieces and the base portion.

3. A connector device comprising:

a connector housing of a flat wire member connector of two-directional connection type having insertion openings provided at its front and rear sides for receiving flat wire members, the flat wire member connector being a circuit board connector to be secured to a circuit board, and a connector terminal to be accommodated in the connector housing, and including:

a press-in portion which extends in forward and backward directions and is to be pressed into a fixing hole formed in the connector housing from the front end side thereof;

a pair of front and rear contact portions provided at positions vertically displaced from the press-in portion to be brought into contact with the flat wire members, the contact portions being joined to the press-in portion via a portion between the contact portions; and a contact portion provided at the press-in portion of the connector terminal to be brought into contact with the circuit board.

4. A connector device according to claim 3, wherein the connector housing includes a raised portion for locating the insertion openings for the flat wire members at positions distanced from the circuit board, and the press-in portion is pressed into the raised portion of the connector housing.

5. A connector device according to claim 3, wherein the contact portion of the connector terminal includes a base portion extending in forward and backward directions and joined to the press-in portion, and deflectable pieces provided between the base portion and the press-in portion at the opposite sides of a portion joining the base portion and the press-in portion, the flat wire members are to be inserted between the deflectable pieces and the base portion, the connector housing includes a raised portion for locating the insertion openings for the flat wire members at positions distanced from the circuit board, and the press-in portion is pressed into the raised portion of the connector housing.

6. A connector device according to claim 3, wherein the contact portion of the connector terminal includes a base portion extending in forward and backward directions and joined to the press-in portion, and deflectable pieces provided between the base portion and the press-in portion at the opposite sides of a portion joining the base portion and the press-in portion, the flat wire members are to be inserted between the deflectable pieces and the base portion, the flat wire members are held in the connector housing of the flat wire member connector by being inserted through the insertion openings with a supporting member placed thereon, and a contact to be brought into contact with the corresponding flat wire member is provided on a side of each deflectable piece opposite from the press-in portion.

7. A connector device according to claim 6, wherein the connector housing includes a raised portion for locating the insertion openings for the flat wire members at positions distanced from the circuit board, and the press-in portion is pressed into the raised portion of the connector housing.

8. A method for producing a plurality of connector terminals, each to be accommodated in a connector housing of a flat wire member connector of two-directional connection type having insertion openings provided at its front and rear sides for receiving flat wire members, the flat wire member connector being a circuit board connector to be secured to a circuit board, each connector terminal comprising: a press-in portion which extends in forward and backward directions and is to be pressed into a fixing hole formed in the connector housing from the front end side thereof; a pair of front and rear contact portions provided at positions vertically displaced from the press-in portion to be brought into contact with the flat wire members, the contact portions being joined to the press-in portion via a portion between the contact portions; and a contact portion provided at the press-in portion of the connector terminal to be brought into contact with the circuit board, the method comprising the step of:

stamping out a thin metallic material by a press to form a plurality of connector terminals arrayed in a row along a strip-shaped carrier such that the press-in portions of the respective connector terminals are separably connected with the carrier at the rear ends thereof with respect to the inserting direction of the connector terminals into a connector housing.

* * * * *